US011663935B1

(12) United States Patent
Jarvis et al.

(10) Patent No.: US 11,663,935 B1
(45) Date of Patent: May 30, 2023

(54) LAUNCHABLE COMMUNICATION DEVICE

(71) Applicants: Richard Wellman Jarvis, Worcester, MA (US); Mei Fong Jarvis, Worcester, MA (US)

(72) Inventors: Richard Wellman Jarvis, Worcester, MA (US); Mei Fong Jarvis, Worcester, MA (US)

( * ) Notice: Subject to any disclaimer, the term of this patent is extended or adjusted under 35 U.S.C. 154(b) by 0 days.

(21) Appl. No.: 17/989,927

(22) Filed: Nov. 18, 2022

Related U.S. Application Data

(60) Provisional application No. 63/334,790, filed on May 26, 2022.

(51) Int. Cl.
*G09F 17/00* (2006.01)
*B63B 22/00* (2006.01)

(52) U.S. Cl.
CPC ..... *G09F 17/00* (2013.01); *B63B 22/00* (2013.01); *B63B 2201/00* (2013.01)

(58) Field of Classification Search
CPC ..... G09F 17/00; B63B 22/00; B63B 2201/00
See application file for complete search history.

(56) References Cited

U.S. PATENT DOCUMENTS

| | | | | |
|---|---|---|---|---|
| 4,144,606 | A | 3/1979 | McIntyre | |
| 5,329,873 | A | 7/1994 | Tiballi | |
| 5,403,219 | A | 4/1995 | Ryan | |
| 5,735,719 | A | 4/1998 | Berg | |
| 5,924,669 | A * | 7/1999 | Richins | G09F 17/00 248/513 |
| 7,303,453 | B1 * | 12/2007 | Bourke | B63B 22/22 441/6 |
| 2012/0171911 | A1 | 7/2012 | Pisor | |

* cited by examiner

*Primary Examiner* — Stephen P Avila
(74) *Attorney, Agent, or Firm* — Sagacity Legal, PLLC

(57) ABSTRACT

A launchable communication device for divers includes a flag, a flag operating assembly, and a receptacle. The flag is coupled to the flag operating assembly and is positionable between an extended position and a collapsed position to facilitate an opening and closing of the flag in order to communicate with others in the vicinity.

19 Claims, 8 Drawing Sheets

LAUNCHABLE COMMUNICATION DEVICE

CROSS-REFERENCE TO RELATED APPLICATIONS

The present application is related to and claims the benefit under 35 U.S.C. § 119(e) from U.S. Provisional Patent Application Ser. No. 63/334,790 and contains at least a claim to a claimed invention that has an effective filing date as defined in 35 U.S.C 100(i) that is on or after Mar. 16, 2013, the following U.S. application commonly owned with this application by Richard Wellman Jarvis and Mei Fong Jarvis: Ser. No. 63/334,790 filed on Apr. 26, 2022, titled "Launchable Diver Distress Surface or Under Surface Signal Assembly", the entire contents of which being incorporated herein by reference.

BACKGROUND OF THE INVENTION

Traditionally, a dive flag or other similar marker is used to identify a scuba diver's underwater position and warn surface vessels that a diver is in the vicinity. The traditional surface marker buoy typically includes a permanently attached flag, which may be vulnerable to winds and waves. The traditional dive marker is simply a fixed location indicator.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
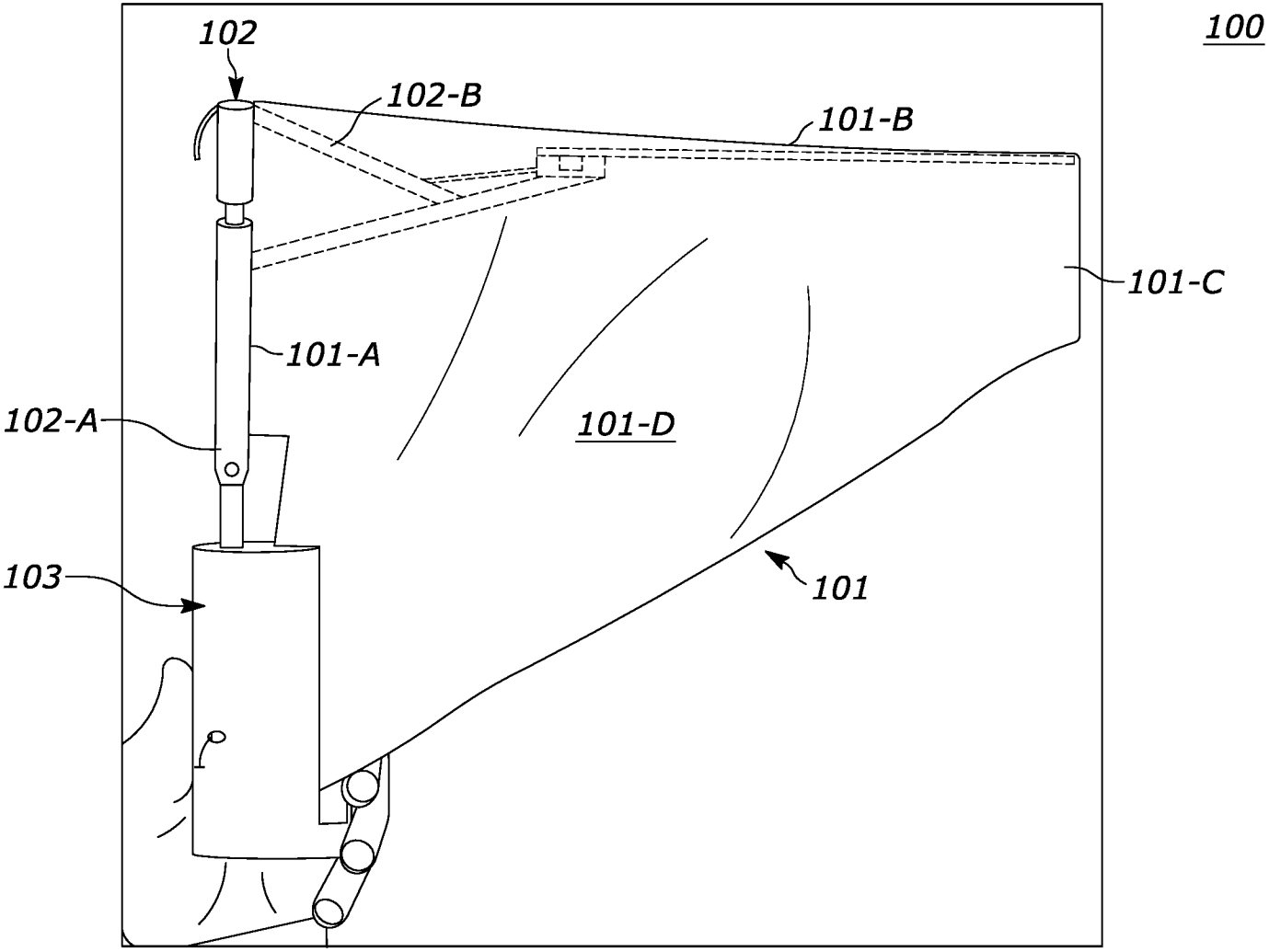
FIG. 1 is a front view illustrating a launchable communication device in an extended position in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

The embodiments described herein are related to a communication device, and, in particular, to a launchable communication device that assists divers to communicate with others in the vicinity.

In one aspect, a launchable communication device for divers is described. The launchable communication device includes a flag with a plurality of parts including a hoist, a fly, and a fly end of the flag. The launchable communication device further includes a flag operating assembly having a hollow vertically oriented bar and a horizontal bar linkage. The hollow vertically oriented bar of the flag operating assembly includes a top end and a bottom end, where the bottom end includes a launcher to actuate the flag operating assembly.

The launchable communication device in addition includes a plurality of connectors operatively connecting the hollow vertically oriented bar to the horizontal bar linkage. The launchable communication device moreover includes a receptacle encasing the bottom end of the hollow vertically oriented bar of the flag operating assembly, wherein the top end of the hollow vertically oriented bar is mechanically connected in parallel with the hoist of the flag. The horizontal bar linkage runs from the hoist of the flag through the fly of the flag. The launchable communication device in addition includes where the horizontal bar linkage of the flag operating assembly is positionable between an extended position and a collapsed position, where the extended position facilitates an opening of the flag and the collapsed position facilitates a closing of the flag.

In another aspect, a method for launching the launchable communication device is described. The method includes securing the launchable communication device to a flotation device, further releasing the launcher, and actuating the flag operating assembly thereby opening the flag. The launchable communication device 100 can be used during water sports activities one or more selected from a group comprising scuba diving, cave diving, deep diving, freediving, ice diving, mermaiding, underwater photography or videography, wreck diving, spearfishing, and other water activities. The launchable communication device 100 allows the diver to communicate with other divers or other personnel in the vicinity whenever required. The launchable communication device 100 allows the diver to communicate with others in various situations including the emergency situation comprising one or more selected from a group comprising decompression sickness, arterial gas embolism, nitrogen narcosis, high-pressure nervous syndrome, oxygen toxicity, pulmonary barotrauma, bodily pain and the like. It will be appreciated if the examples provided herein are non-limiting usage and functionality of the launchable communication device 100.

Referring to FIG. 1, a launchable communication device 100 is illustrated and described. The launchable communication device 100 includes a flag 101, a flag operating assembly 102, and a receptacle 103. The flag 101 with a plurality of parts includes a hoist 101-A (mechanically affixed to the flag operating assembly 102), a fly 101-B, and a fly end 101-C. The hoist 101-A is referred to the vertical dimension part of the flag nearest the flag operating assembly 102. The fly 101-B is referred to the length of a flag 101 from the hoist 101-A to the fly end 101-C. The fly end 101-C is the loose end that blows and flaps in the wind. The flag 101 further includes a field 101-D having a message (for example SOS) as a signal to communicate, wherein the message comprises one or more selected from a group comprising numbers, letters, codes, or designs. It will further be appreciated that in alternative embodiments the flag 101 is constructed from a single or multilayer water-resistant product material selected from a group of a nylon, a polyester, a copper fabric, a quilting fabric and a silk.

Figure 2:
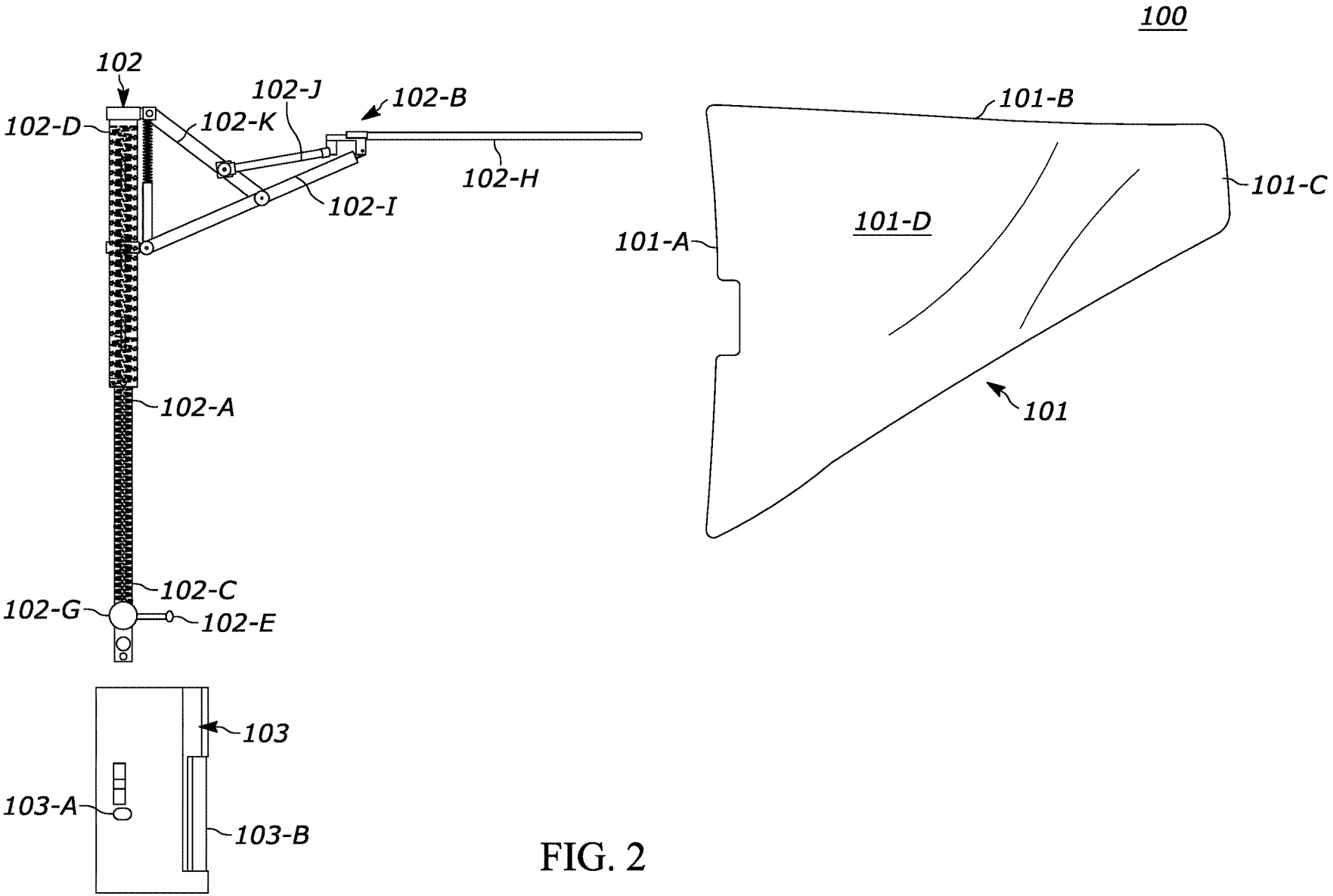
FIG. 2 is a partial, exploded view illustrating a launchable communication device in accordance with some embodiments.

Referring to FIG. 2, a partial, exploded view illustrating the launchable communication device 100 is described. As illustrated, the flag operating assembly 102 includes a hollow vertically oriented bar 102-A and a horizontal bar linkage 102-B, where the horizontal bar linkage 102-B runs from the hoist 101-A of the flag 101 through the fly 101-B of the flag 101. The launchable communication device 100 also includes the receptacle 103 which encases the hollow vertically bar oriented bar 102-A of the flag operating assembly 102, wherein the receptacle 103 includes a plurality of open apertures 103-A and 103-B (not illustrated). The hollow vertically oriented bar 102-A includes a top end 102-D and a bottom end 102-C, where the receptacle 103 is configured to receive the bottom end 102-C of the hollow vertically oriented bar 102-A of the flag operating assembly 102.

Referring to FIGS. 1 and 2, the receptacle 103 also includes a fastener (not illustrated) disposed at an outer surface of the receptacle 103; where the fastener removably secures the launchable communication device 100 to a flotation device. The fastener comprises one or more selected from a group comprising a hook-and-loop fastener, a snap closure, a button closure, and an elastic element. The flotation device comprises one or more selected from a group comprising a surface marker buoy, a diving marker buoy, a closed-end surface marker buoy, an open-end surface marker buoy, and a delayed surface marker buoy. The receptacle 103 is constructed from a single or a multilayer water-resistant product material selected from a group of a cotton, a polyester, a copper fabric, a quilting fabric, a silk, a polyethylene, and a polymer. It will further be appreciated that in alternative embodiments, the receptacle of any shape or size encasing the flag operating assembly fully or partially.

Figure 3:
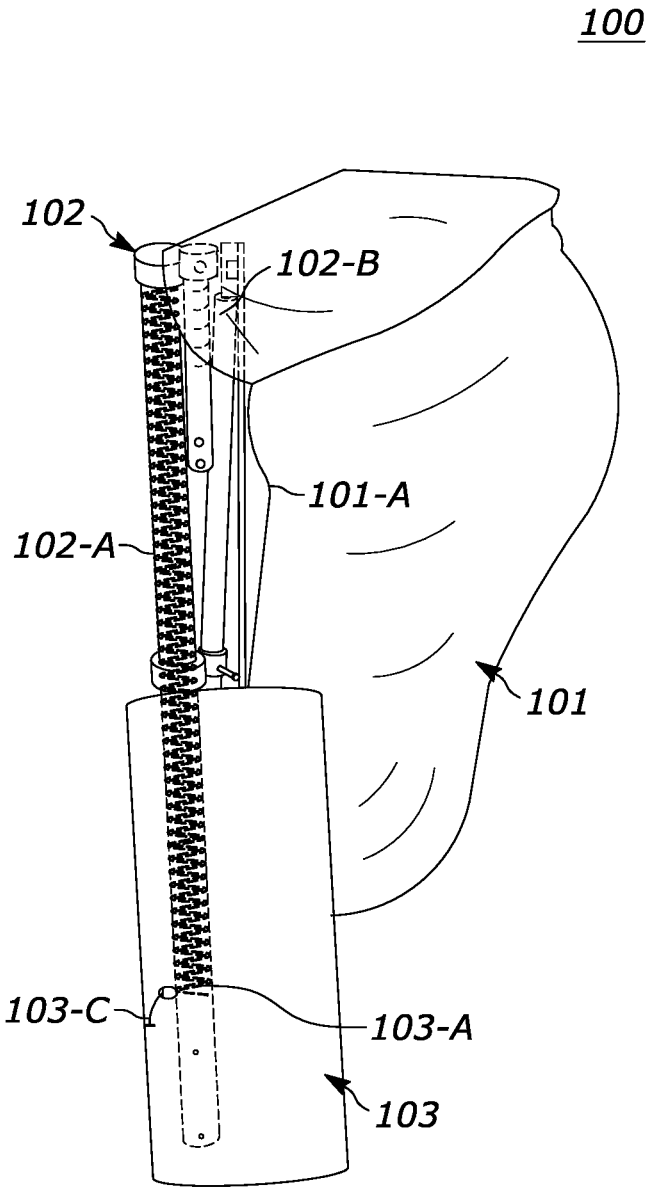
FIG. 3 illustrates a view of a launchable communication device in a collapsing position in accordance with some embodiments.

Continuing, referring to the FIG. 2, the top end 102-D of the hollow vertically oriented bar 102-A is mechanically connected in parallel with the hoist 101-A of the flag 101, where the horizontal bar linkage 102-B runs from the hoist 101-A of the flag 101 through the fly 101-B of the flag 101, thereby facilitating opening and closing of the flag. The horizontal bar linkage 102-B of the flag operating assembly 102 is positionable between an extended position and a collapsed position, wherein the extended position facilitates the opening of the flag 101 as illustrated in FIG. 1 and the collapsed position facilitates the closing of the flag 101 as illustrated in FIG. 3. The horizontal bar linkage 102-B of the flag operating assembly 102 when positioned in the extended position creates a ninety degree angle between the horizontal bar linkage 102-A and the hollow vertically bar oriented bar 102-A of the flag operating assembly 102, thereby opening of the flag 101 with the hoist 101-A and the fly end 101-C away from each other as illustrated in FIG. 1. The horizontal bar linkage 102-B of the flag operating assembly 102 when positioned in the collapsed position creates a zero degree angle between the horizontal bar linkage 102-A and the hollow vertically bar oriented bar 102-A of the flag operating assembly 102, thereby closing of the flag 101 with the hoist 101-A and the fly end 101-C (not illustrated) adjacent to each other as illustrated in FIG. 3. Details related to each of these aforesaid components of the launchable communication device 100 is described further below. Referring to FIG. 3, the hollow vertically oriented bar 102-A of the flag operating assembly 102 includes a pull cord 103-C protruding out from the open aperture 103-A of the receptacle 103.

Figure 4:
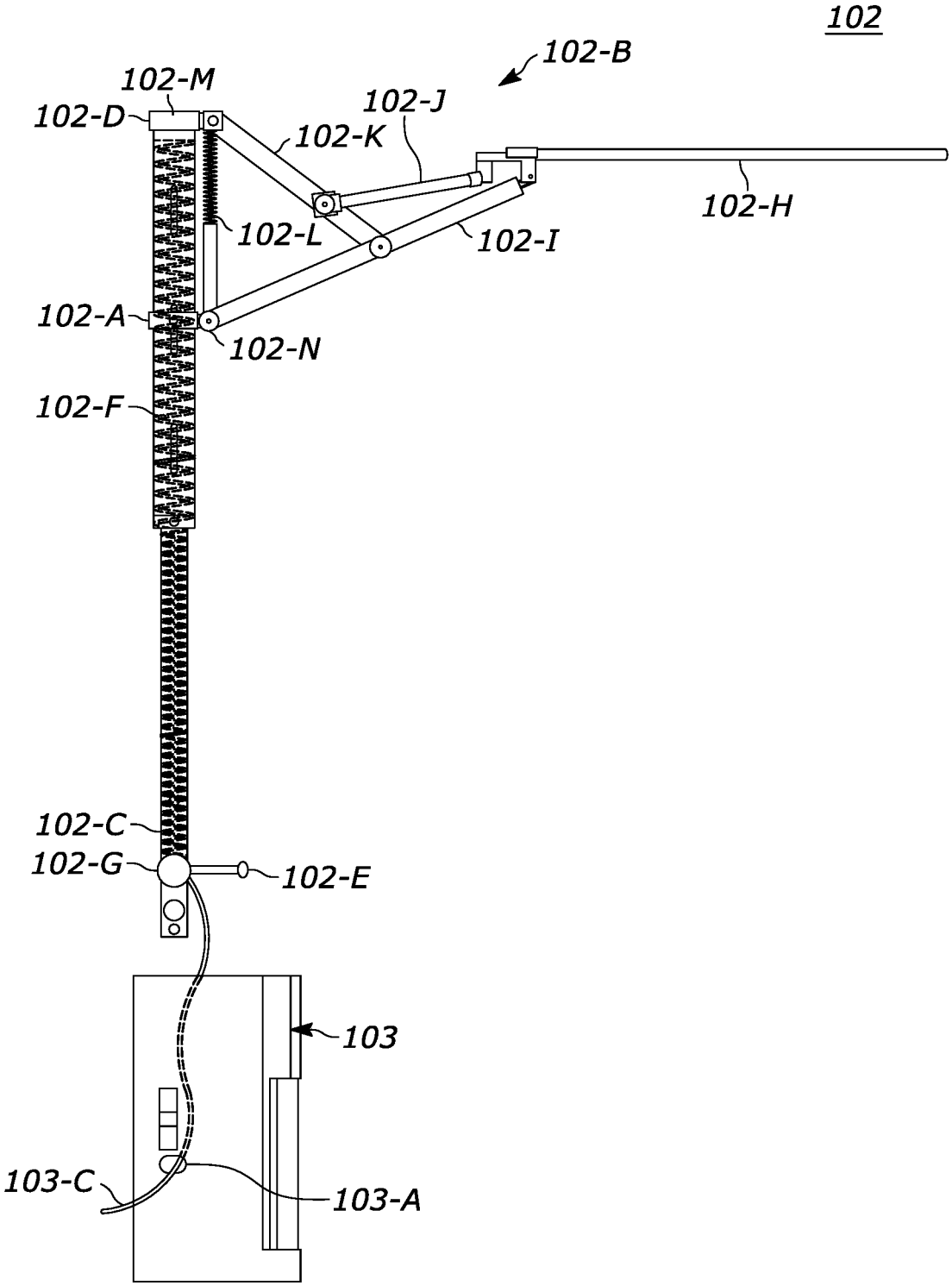
FIG. 4 illustrates a view of a flag operating assembly of a launchable communication device in an extended position in accordance with some embodiments.
Figure 5:
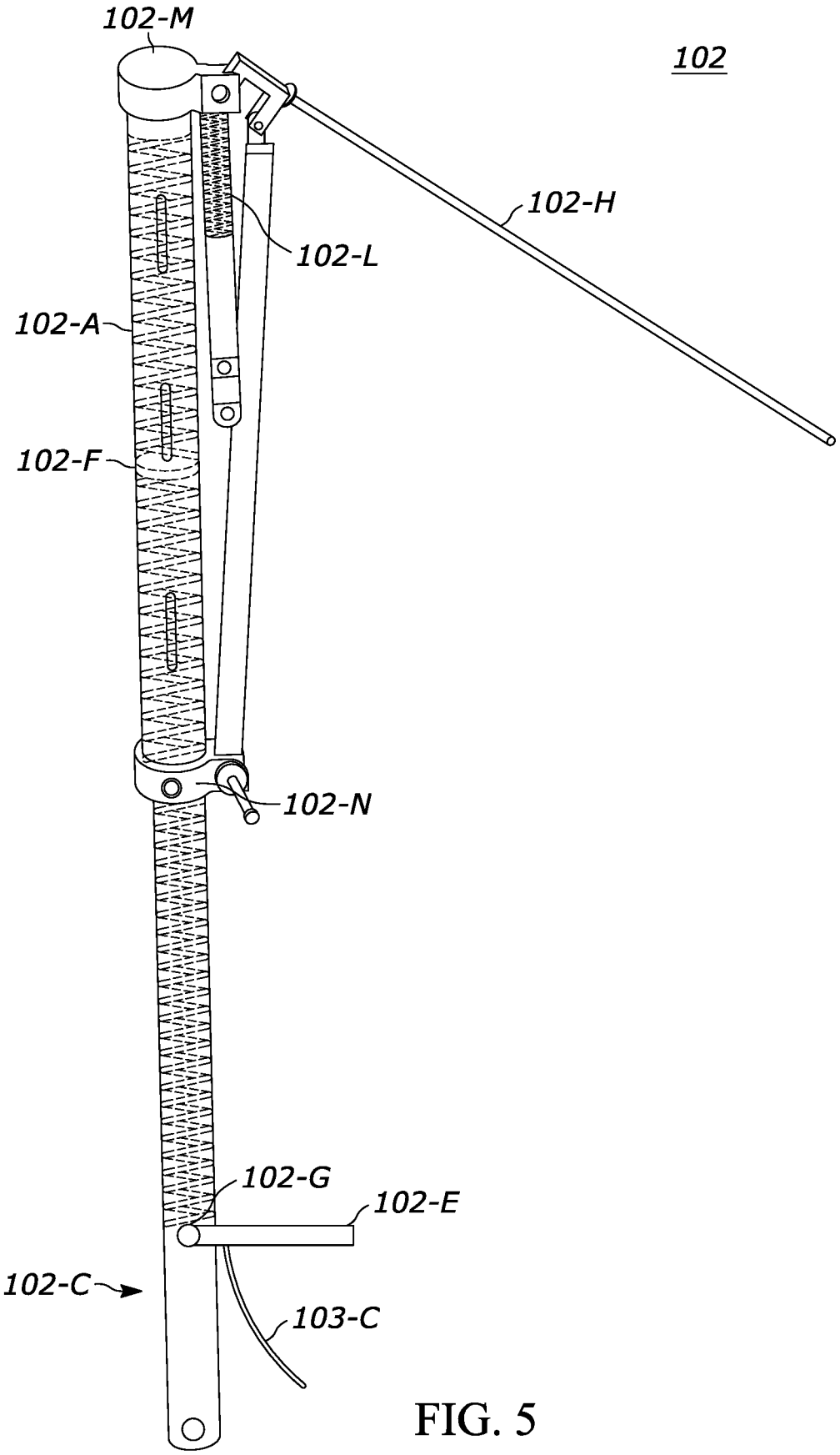
FIG. 5 illustrates a view of a flag operating assembly of a launchable communication device in a partially collapsed position in accordance with some embodiments.

Referring now to FIGS. 4 and 5, in light of FIGS. 1, 2 and 3, the hollow vertically oriented bar 102-A of the flag operating assembly 102 includes a lock pin 102-E operatively coupled to a first plurality of springs 102-F at the launcher 102-G. The first plurality of springs 102-F runs from the top end 102-D to the bottom end 102-C of the hollow vertically oriented bar 102-A. The launcher 102-G is mechanically connected to the first plurality of springs 102-F and the lock pin 102-E, wherein the lock pin 102-E further mechanically affixes to the pull cord 103-C. The launcher 102-G is located at the bottom end 102-C of the hollow vertically oriented bar 102-A and designed to actuate the flag operating assembly 102. The lock pin lock pin 102-E and the launcher 102-G are encased inside the receptacle 103, wherein the pull cord 103-C protrudes out from the open aperture 103-A of the receptacle 103 to allow the user essay access of the pull cord 103-C during diving or related activities.

The lock pin 102-E is configured to lock the hollow vertically oriented bar 102-A and horizontal bar linkage 102-B of the flag operating assembly 102 in the collapsed position as illustrated in FIG. 5. Once the pull cord 103-C is pulled by the user, it initiates the launcher 102-G to release lock pin 102-E from the first plurality of springs 102-F, thereby opening of the flag operating assembly 102 as illustrated in FIG. 4. In so doing, the hollow vertically oriented bar 102-A takes or receives an impact by the launcher 102-G. This impact is further received by the horizontal bar linkage 102-B, which is mechanically attached to the top end 102-D of the hollow vertically oriented bar 102-A to facilitate the opening of the flag operating assembly 102.

Referring to FIGS. 2 and 4, the horizontal bar linkage 102-B of the flag operating assembly 102 includes a plurality of bars 102-H, 102-I, 102-J and 102-K, each of the bars being structured and disposed to be engaged with one another. The horizontal bar linkage 102-B further includes the second plurality of springs 102-1 operably coupled to the plurality of bars 102-I and 102-K. The bar 102-K is mechanically connected to the plurality of bars 102-I and 102-J which further connects to the bar 102-H thereby Ruining the horizontal bar linkage 102-B. The plurality of bars 102-H, 102-K and 102-I are mechanically attached to the hoist 101-A of the flag 101 running through the fly 101-B of the flag 101. In an alternate embodiment, the horizontal bar linkage 102-B can be composed of additional or fewer components.

Now referring to FIGS. 4 and 5, the first plurality of springs 102-F are fitted inside the hollow vertically oriented bar 102-A which mechanically connects to the horizontal bar linkage 102-K and 102-I via a plurality of connectors 102-M and 102-N respectively. The plurality of connectors 102-M and 102-N facilitates the movement between the hollow vertically oriented bar 102-A and horizontal bar linkage 102-B after receiving the impact from the launcher 102-G.

The first 102-F and second 102-L plurality of springs includes a plurality of torsion springs and a plurality of compression springs. It will be appreciated that the first 102-F and second 102-L plurality of springs, can include any other springs or related mechanism now known or in the future developed. The plurality of connectors 102-M and 102-N comprises one or more selected from a group comprising a one or more selected from a group comprising a clip, a clasp, a hook, a hook-and-loop fastener, a snap closure, a button closure, a pin and an elastic element.

Figure 6:
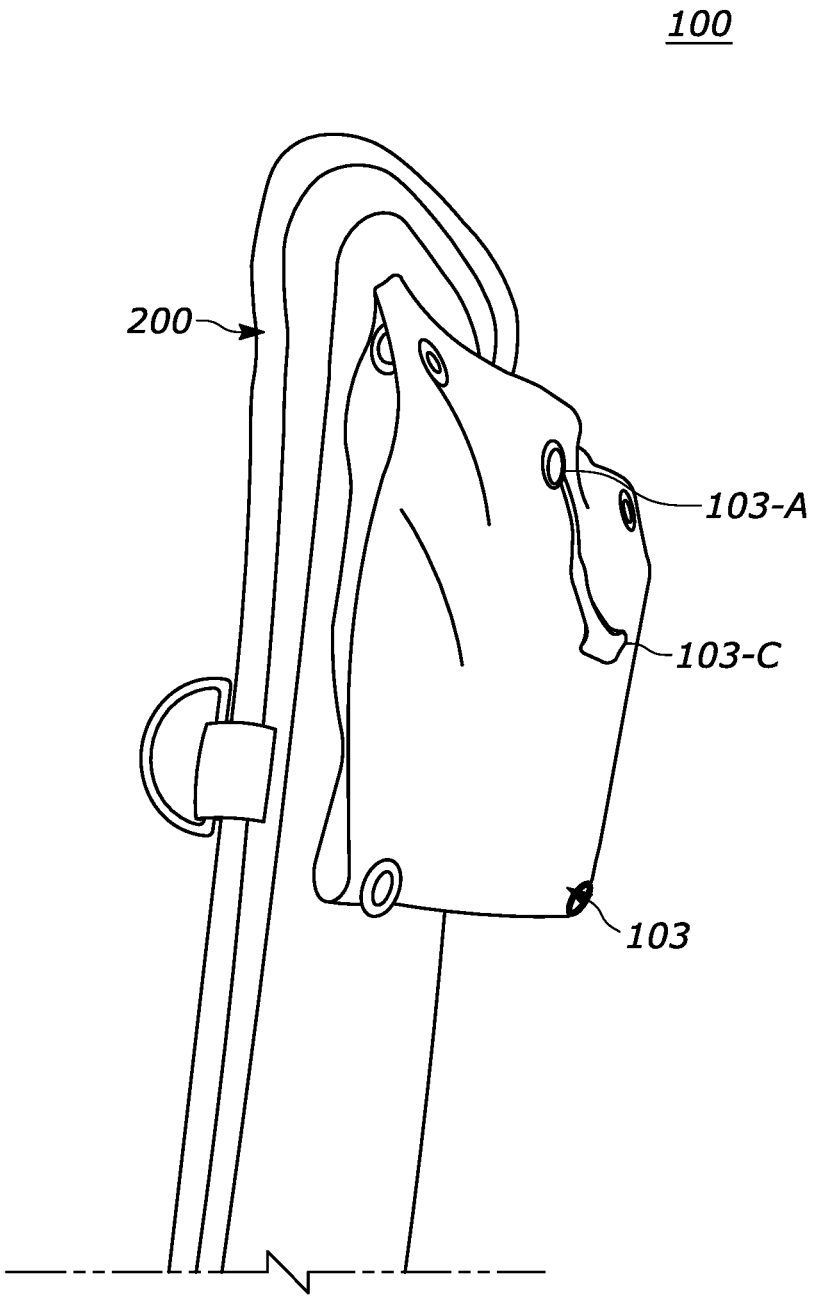
FIG. 6 is an exemplary illustration of a launchable communication device secured on a flotation device in accordance with some embodiments.
Figure 7:
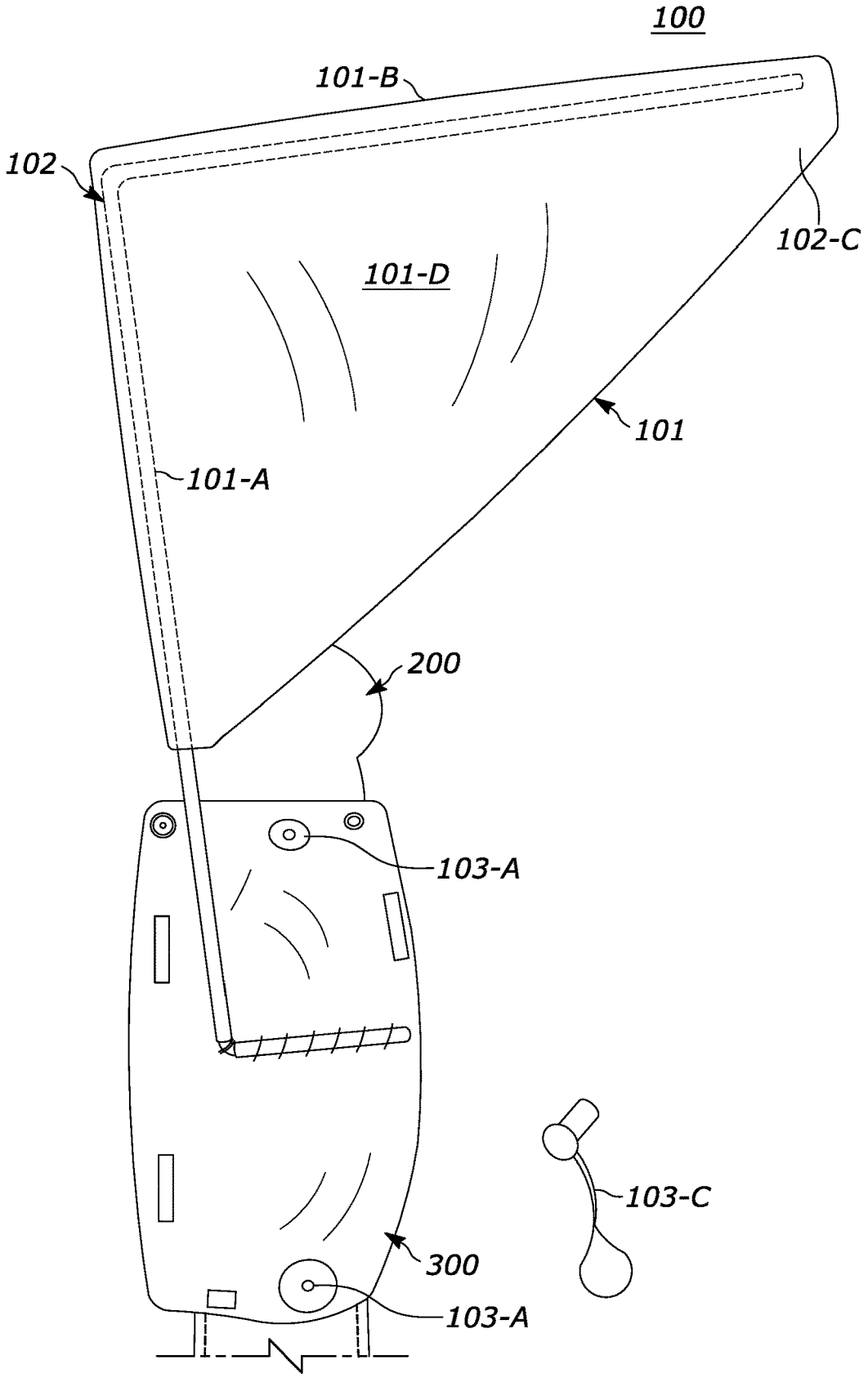
FIG. 7 is an exemplary illustration of a launchable communication device secured on a flotation device in accordance with some embodiments.

Referring to FIGS. 6 and 7, an exemplary illustration of the launchable communication device 100 secured on the flotation device 200, described hereinafter. The exemplary illustrations are described to provide alternative embodiments for the receptacle 103 in light of similar embodiments of the flag operating assembly 102 as illustrated in FIGS. 1 to 5.

As illustrated in FIGS. 6 and 7, the launchable communication device 100 is in the collapsed position, where the flag 101 (not illustrated) and the flag operating assembly 102 is encased in the receptacle 103. The receptacle 103 is designed to receive the entire flag operating assembly 102 within the receptacle as opposed to the partially encasing the hollow vertically oriented bar 102-A as illustrated in FIGS. 1 to 4. In this alternative embodiment, the receptacle 103 is constructed as a pouch or a bag. It will be appreciated that the examples provided herein are non-limiting usage and functionality of the receptacle 103. The launchable communication device 100 is secured on the flotation device 200 using the fastener (not illustrated). The fastener comprises one or more selected from a group comprising a hook-and-loop fastener, a snap closure, a button closure, and an elastic element. The flotation device comprises one or more selected from a group comprising a surface marker buoy, a diving marker buoy, a closed-end surface marker buoy, an open-end surface marker buoy, and a delayed surface marker buoy. The receptacle 103 is constructed from a single or a multilayer water-resistant product material selected from a group of a cotton, a polyester, a copper fabric, a quilting fabric, a silk, a polyethylene, and a polymer. It will further be appreciated that in alternative embodiments, the receptacle of any shape or size encasing the flag operating assembly 102 fully or partially. The launchable communication device 100 also includes a pull cord 103-C protruding out from one of the open aperture 103-A of the receptacle 103. In this embodiment, flag operating assembly 102 and flag 101 are configured to be manually closed by the diver.

Figure 8:
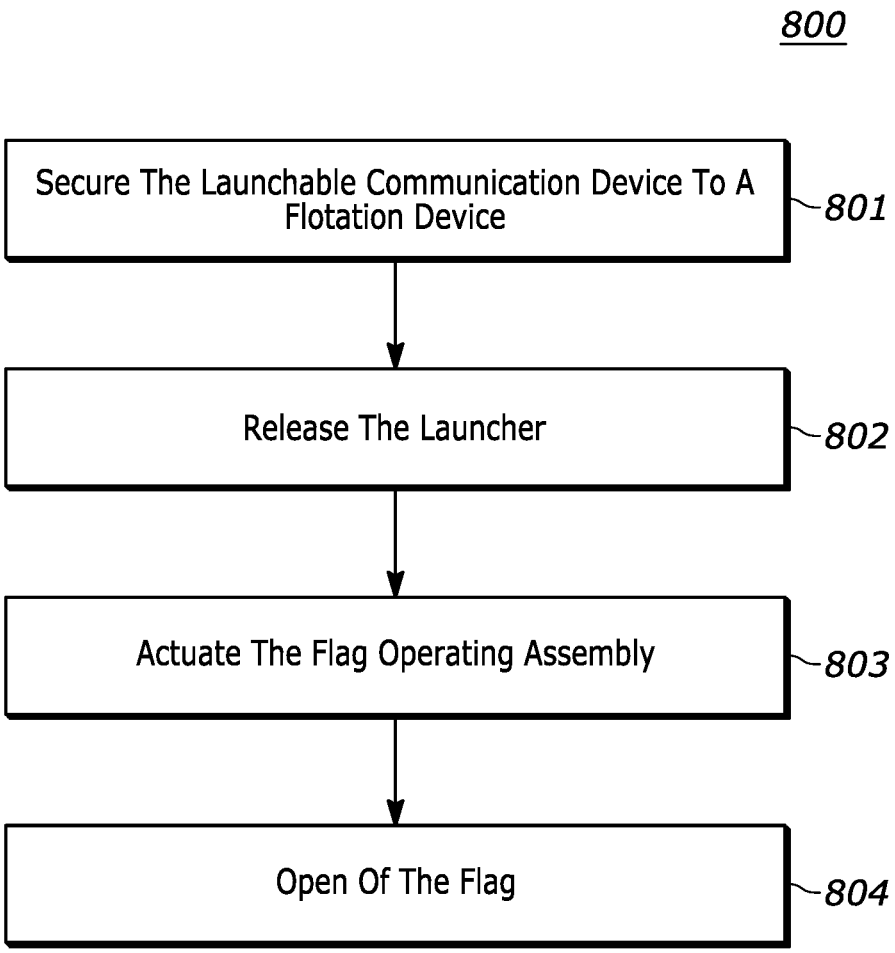
FIG. 8 is a flowchart illustrating a method of operating a launchable communication device in accordance with some embodiments.

FIG. 9 is a flowchart illustrating a method of operating the launchable communication device 100 in accordance with some embodiments. A process of launching the communication device 100 by the diver will be described hereinafter with reference to FIG. 8 indicated as 800, beginning with operation 801. In operation 801, the diver secures the launchable communication device 100 to the flotation device in order to carry the device 100. The launchable communication device 100 is secured on the flotation device using the fasteners as mentioned earlier.

In the operation 802, the diver releases the launcher 102-G of the launchable communication device 100 by pulling the pull cord 103-A, which mechanically connects the lock pin 102-E. Once the pull cord 103-A is pulled by the diver the lock pin 102-E releases the launcher 102-G thereby actuating the flag operating assembly 102 as indicated in the operation 803.

In operation 804, the flag operating assembly 102 opens the flag 101. In this operation, the launcher 102-G releases the lock pin 102-E from the first plurality of springs 102-F, thereby opening the flag operating assembly 102 as illustrated in FIG. 4. In so doing, the hollow vertically oriented bar 102-A takes or receives an impact by the launcher 102-G. This impact is further received by the horizontal bar linkage 102-B, which is mechanically attached to the top end 102-D of the hollow vertically oriented bar 102-A to facilitate the opening of the flag operating assembly 102. This impact further releases the flag 101 which is mechanically connected to the hollow vertically oriented bar 102-A and horizontal bar linkage 102-B.

According to some embodiments, the launchable communication device 100 be formed of any shape or size. In an alternate embodiment, the launchable communication device 100 can be composed of additional or fewer components. In one of the embodiments, the launchable communication device 100 is designed to be secured to the flotation device of any size or shape. According to an embodiment, the launchable communication device 100 is carried by the diver without securing it to the flotation device.

Referring to FIGS. 1 through 8, the extended and the collapsed position of the launchable communication device 100 is explained. In the collapsed or a partially collapsed position the launchable communication device 100 where the flag 101 and the flag operating assembly 102 are encased inside the receptacle 300 partially or fully. The flag operating assembly 102 and flag 101 are configured to be manually closed by the diver or operatively locked by the lock pin 102-E. The launchable communication device 100 in collapsed or in partially collapsed position is configured to attach to the flotation device. In the extended position, the launchable communication device 100 where the flag 101 and the flag operating assembly 102 are uncovered from the receptacle 103, where the flag 101 opens to allow the diver to communicate with other divers or other personnel in the vicinity.

As used herein, "communication device" refers to means of sending information to communicate with others within the vicinity where the message on the field of the flag is visible to others.

In the foregoing specification, specific embodiments have been described. However, one ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential feature or element of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element preceded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment, the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs), and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application-specific integrated circuits (ASICs), in which each function or some combinations of certain of the functions are implemented as custom logic. Of course, a combination of the two approaches could be used.

Moreover, an embodiment can be implemented as a computer-readable storage medium having computer-readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, the inventive subject matter lies in less than all features of a single disclosed embodiment. Thus the following claims are hereby incorporated into the Detailed Description, with each claim standing on its own as a separately claimed subject matter.

We claim:

1. A launchable communication device for a diver comprising:

a flag with a plurality of parts including:
- a hoist of the flag,
- a fly of the flag, and
- a fly end of the flag;

a flag operating assembly comprising:
- a hollow vertically oriented bar having a top end and a bottom end including:
  - a launcher mechanically affixed to the bottom end of the hollow vertically oriented bar to actuate the flag operating assembly, and a horizontal bar linkage;

a plurality of connectors operatively connecting the hollow vertically oriented bar to the horizontal bar linkage; and a receptacle encasing the bottom end of the hollow vertically oriented bar of the flag operating assembly;

wherein the top end of the hollow vertically oriented bar is mechanically connected in parallel with the hoist of the flag;

wherein the horizontal bar linkage is linked to the top end of the hollow vertically oriented bar and runs from the hoist of the flag through the fly of the flag; and wherein the horizontal bar linkage of the flag operating assembly is positionable between an extended position and a collapsed position, wherein the extended position facilitates an opening of the flag and the collapsed position facilitates a closing of the flag.

2. The launchable communication device of claim 1, wherein the hollow vertically oriented bar further including:

a lock pin operatively coupled to the launcher to actuate the flag operating assembly, a pull cord mechanically affixed to the lock pin to initiate a launch of the launcher, and a first plurality of springs fitted inside the hollow vertically oriented bar and miming from the top end of the hollow vertically oriented bar to the bottom end of the hollow vertically oriented bar, and wherein the first plurality of springs are operatively coupled to the launcher at the bottom end of the hollow vertically oriented bar.

3. The launchable communication device of claim 1, wherein the horizontal bar linkage further including:

a plurality of bars, each of the bars being structured and disposed to be engaged with one another, and a second plurality of springs operably coupled to each of the bars to structure the horizontal bar linkage.

4. The launchable communication device of claim 1, the receptacle further including:

a plurality of open apertures; and a fastener disposed at an outer surface of the receptacle;

wherein the fastener removably secures the launchable communication device to a flotation device.

5. The launchable communication device of claim 4, wherein one of the open apertures of the receptacle receives the hoist and the fly of the flag during the collapsed position of the flag operating assembly.

6. The launchable communication device of claim 2, wherein the lock pin is configured to lock the flag operating assembly and the flag inside the receptacle during the collapsed position of the flag operating assembly.

7. The launchable communication device of claim 2, wherein the launcher and the lock pin are encased in the receptacle, wherein the pull cord is configured to extend out of the receptacle, wherein a pulling of the pull cord initiates an unlocking of the lock pin.

8. The launchable communication device of claim 4, wherein the fastener removably secure the launchable communication device to the flotation device comprises one or more selected from a group comprising a hook-and-loop fastener, a snap closure, a button closure and an elastic element.

9. The launchable communication device of claim 4, wherein the flotation device comprises one or more selected from a group comprising a surface marker buoy, a diving marker buoy, a closed-end surface marker buoy, an open-end surface marker buoy and a delayed surface marker buoy.

10. The launchable communication device of claim 1, wherein the flag further includes a field having a message as a signal to communicate, wherein the message comprises one or more selected from a group comprising numbers, letters, codes or designs.

11. The launchable communication device of claim 1, wherein the flag is constructed from a single or multilayer water-resistant product material selected from a group of a nylon, a polyester, a copper fabric, a quilting fabric and a silk.

12. The launchable communication device of claim 1, wherein the receptacle is constructed from a single or a multilayer water-resistant product material selected from a group of a cotton, a polyester, a copper fabric, a quilting fabric, a silk, a polyethylene, and a polymer.

13. A method for launching a launchable communication device, the method comprising:

securing the launchable communication device to a flotation device, the launchable communication device including:

a flag with a plurality of parts;

a flag operating assembly comprising:

a hollow vertically oriented bar having a launcher, a lock pin, a pull cord attached to the lock pin, and a horizontal bar linkage;

releasing the launcher by pulling the pull cord and unlocking the lock pin;

actuating the flag operating assembly; and opening the flag.

14. The method of claim 13, wherein the horizontal bar linkage further includes a plurality of bars, each of the bars being structured and disposed to be engaged with one another, and wherein the actuating of the flag operating assembly further comprising:

extending the plurality of bars; and opening of the flag.

15. The method of claim 13, wherein the flag with the plurality of parts further includes a hoist of the flag, a fly of the flag, and a fly end of the flag and wherein the opening of the flag further comprising:

extending the horizontal bar linkage running from the hoist of the flag through the fly of the flag.

16. The method of claim 13, wherein the flotation device comprises one or more selected from a group comprising a surface marker buoy, a diving marker buoy, a closed-end surface marker buoy, an open-end surface marker buoy and a delayed surface marker buoy.

17. The method of claim 13, wherein the flag further includes a field having a message as a signal to communicate, wherein the message comprises one or more selected from a group comprising numbers, letters, codes or designs.

18. The method of claim 13, wherein the launchable communication device is secure to the flotation device using a fastener, wherein the fastener comprises one or more selected from a group comprising a hook-and-loop fastener, a snap closure, a button closure and an elastic element.

19. The method of claim 13, wherein the flag is constructed from a single or multilayer water-resistant product material selected from a group of a nylon, a polyester, a copper fabric, a quilting fabric and a silk.

* * * * *